US009266707B2

(12) United States Patent
Baker

(10) Patent No.: US 9,266,707 B2
(45) Date of Patent: Feb. 23, 2016

(54) CIRCUMFERENTIALLY ADJUSTABLE DEVICE FOR TRANSFERRING FUEL ADDITIVES FROM CONTAINERS INTO CAPLESS FUEL SYSTEMS

(71) Applicant: William Edward Baker, Marietta, GA (US)

(72) Inventor: William Edward Baker, Marietta, GA (US)

( * ) Notice: Subject to any disclaimer, the term of this patent is extended or adjusted under 35 U.S.C. 154(b) by 0 days.

(21) Appl. No.: 13/724,118

(22) Filed: Dec. 21, 2012

(65) Prior Publication Data

US 2014/0174602 A1 Jun. 26, 2014

(51) Int. Cl.

| | |
|---|---|
| ***B65D 25/40*** | (2006.01) |
| ***B67C 11/02*** | (2006.01) |
| ***B65D 5/74*** | (2006.01) |
| ***B65D 25/42*** | (2006.01) |
| ***B65D 25/48*** | (2006.01) |
| ***F01M 11/04*** | (2006.01) |

(52) U.S. Cl.

CPC ..... *B67C 11/02* (2013.01); *B65D 5/746* (2013.01); *B65D 25/42* (2013.01); *B65D 25/48* (2013.01); *F01M 11/04* (2013.01)

(58) Field of Classification Search

CPC .... B65D 47/06; B65D 5/746; B65D 75/5883; B65D 25/42; B65D 25/48; B67C 2011/027; B67C 11/02

USPC ..... 222/566, 567, 570, 573, 460–462, 206, 222/210, 215; 141/331, 332

See application file for complete search history.

(56) References Cited

U.S. PATENT DOCUMENTS

| | | | | | |
|---|---|---|---|---|---|
| 1,428,297 | A | * | 9/1922 | Price | 222/478 |
| 1,732,080 | A | * | 10/1929 | Boe | 222/478 |
| 2,309,385 | A | * | 1/1943 | Fleming | 220/717 |
| D241,597 | S | * | 9/1976 | Confer et al. | D23/200 |
| 4,150,768 | A | * | 4/1979 | Maynard, Jr. | 222/89 |
| 4,856,568 | A | * | 8/1989 | Murphy et al. | 141/337 |
| 5,065,913 | A | * | 11/1991 | Glasener | 222/528 |
| 5,092,498 | A | * | 3/1992 | Willems et al. | 222/526 |
| 5,104,012 | A | * | 4/1992 | McAllister et al. | 222/528 |
| 8,118,198 | B1 | * | 2/2012 | Watson | 222/462 |
| 2011/0297706 | A1 | * | 12/2011 | Zoss | 222/567 |

* cited by examiner

*Primary Examiner* — Nicholas J Weiss

(74) *Attorney, Agent, or Firm* — Carla Gannon Law

(57) ABSTRACT

Devices that assist in transferring liquid from commercially available fuel additive containers into capless fuel system intakes generally include an enlarged mouth portion and a narrower nozzle portion, with the mouth portion detachably engaging with an additive container, and the nozzle portion inserted into a capless fuel system intake, such that the capless fuel system's opening flap is held in the opened position. The mouth of the device includes a plurality of hinge points that permit circumferential enlargement of the aperture, thereby allowing the device to form a substantially leak-proof frictional engagement with the neck of fuel additive containers having different diameters. In this manner devices can be used with almost all additive containers, regardless of the type, size and/or manufacturer.

6 Claims, 4 Drawing Sheets

CIRCUMFERENTIALLY ADJUSTABLE DEVICE FOR TRANSFERRING FUEL ADDITIVES FROM CONTAINERS INTO CAPLESS FUEL SYSTEMS

BACKGROUND OF THE INVENTION

The present invention relates to pourable matter delivery devices, and more specifically, to a pouring device having a circumferentially expandable mouth and fixed stem for accommodating fuel additive container openings of a range of sizes.

Many vehicle operators utilize fuel additives in order to modify or improve certain characteristics such a gasoline's octane rating, or act as a corrosion inhibitor or lubricant. An example of a common and commercially available fuel additive is STP® brand "Gas Treatment". Fuel additives typically include components such as metal deactivators, corrosion inhibitors, oxygenates and antioxidants. Typically a user purchases a fuel additive in a container having an elongated neck that terminates in the container opening. This design allows many fuel additive users to simply remove the container cap, direct the opening of the container into the gas tank opening, and pour in the contents. The specific size and shape of the container varies by manufacturer and product.

The addition of fuel additives into capless gas systems, however, is more complicated. In general, a capless gas system does not have a cap, but rather a self-sealing mechanism at the point of entry of fuel for a fuel tank. This self-sealing mechanism is typically a spring-loaded interior lid that allows entry of a standard fuel-pump nozzle, but closes off when a nonstandard fuel-pump nozzle attempts to gain entry. Capless gas systems are gaining in popularity with automobile manufacturers because they are considered an improvement over standard systems due to their ability to prevent fuel theft, and because they greatly reduce environmental hazards such as fuel spillage and evaporation that arises from improperly tightened or otherwise defective gas caps.

However, since capless gas systems are designed to prevent the introduction of substances into the gas tank using a nonstandard nozzle or spout, it is not possible to introduce fuel additives to capless gas systems using standard fuel additive containers. As a result, motorists having capless gas systems either can't use fuel additives, or experience great difficulty if they attempt to use a standard fuel additive container to introduce the fuel additive into their gas tank. Spillage of these liquids can be hazardous to both people and the environment.

In order to resolve such issues, there is a need for a device that facilitates the introduction of fuel additives into capless gas systems. It is desirable that this device can be used with a variety of fuel additive containers, and particularly with a range of neck diameters and openings. It is desirable that this device is capable of achieving a frictional fit including a tight seal that is not prone to leakage, and that these characteristics are achieved regardless of the neck and/or opening size of the engaged container. It is desirable that this device is simple and economical to manufacture, and easy to transport and use. It is desirable that this device does not require multiple parts that must be assembled and stored.

SUMMARY OF THE INVENTION

The present inventions generally pertain to devices that assist in transferring pourable matter from containers such as commercially available fuel additive containers, into capless fuel system intakes. An exemplary device may be conceptualized as a funnel insofar as it has an enlarged mouth portion and a narrower nozzle portion, with the mouth portion detachably engaging with an additive container, and the nozzle portion inserted into a capless fuel system intake, such that the opening flap of the capless fuel system is held in the opened position. The mouth of the device includes a plurality of hinge points that permit circumferential enlargement of the aperture, thereby allowing the device to form a substantially leak-proof frictional engagement with the neck of containers having different diameters. In this manner the present invention can be used with a variety of containers, regardless of the type, manufacturer, and so forth.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The following structure numbers shall apply:

10 is a pouring device;
12 is a nozzle;
13 is a mouth;
14 are hinge points;
15 is an angled transition;
16 is a flange;
17 is an aperture;
18 is a one quart oil container;
19 is a neck;
20 is flowing fuel additive/liquid;
22 is a nozzle opening;
24 is a quart oil bottle opening;
26 is a fuel additive container;
28 are oil container threads;
30 are fuel additive container threads;
32 is a fuel additive container opening;
34 is a capless fuel system inlet;
36 is a capless fuel system opening flap;
38 is a vehicle body panel;
40 is a capless fuel system door;
60 is a distal end; and
70 is a proximal end.

Figure 1:
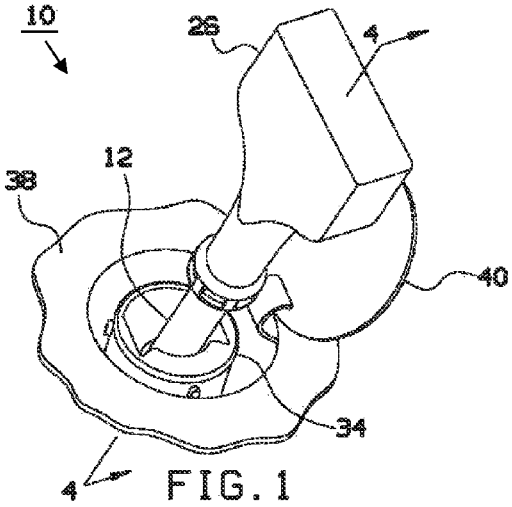
FIG. 1 is a perspective view of the invention shown in use.

Referring to FIG. 1, pouring device 10 generally engages with fuel additive container 26, for insertion of nozzle 12 into capless fuel system inlet 34. An example of a capless fuel system is Ford Motor Company's EASY FUEL® system. As used herein, "pourable matter" refers to substances, such as liquids, semi-solids, particulates, and the like, which can be poured. Also, "fuel additives" generally refer to liquids and semi-solids that are added to a fuel system.

Figure 2:
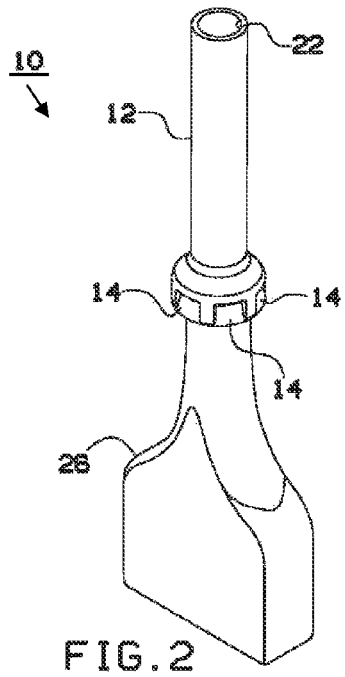
FIG. 2 is a perspective view of the invention shown installed on a fuel additive container 26.
Figure 3:
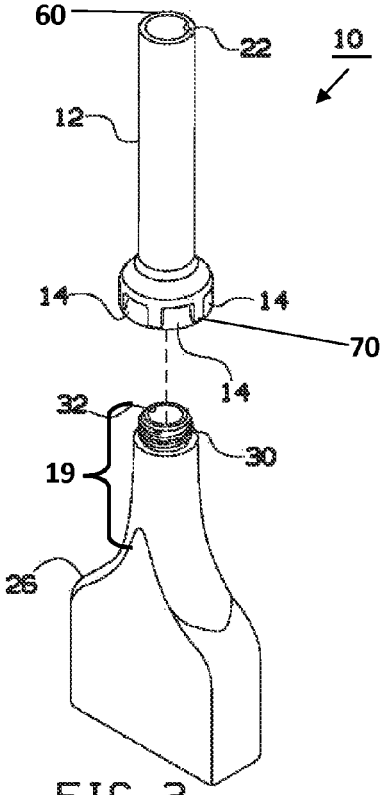
FIG. 3 is an exploded perspective view of the invention.

Engagement and disengagement of pouring device 10 with fuel additive container 26 is set forth in FIGS. 2 and 3, respectively. Such engagement is deemed detachable engagement insofar as pouring device 10 forms a frictional connection with container 26, such that the assembly can be inverted for use and pouring without pouring device 10 inadvertently disengaging from container 26, but said engagement isn't so strong that pouring device 10 can't be removed using moderate human strength.

Figure 4:
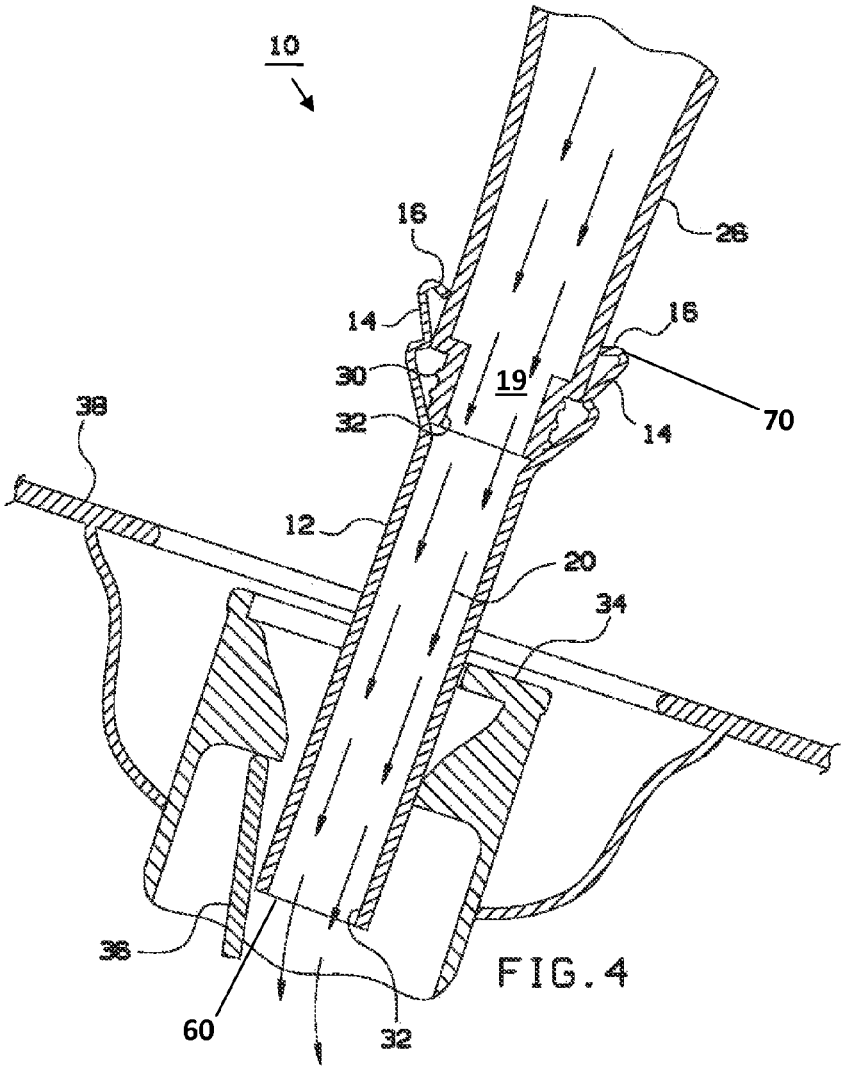
FIG. 4 is a detailed section view of the invention taken along; line 4-4 in FIG. 1 shown with the capless fuel system door 40 removed for clarity.
Figure 5:
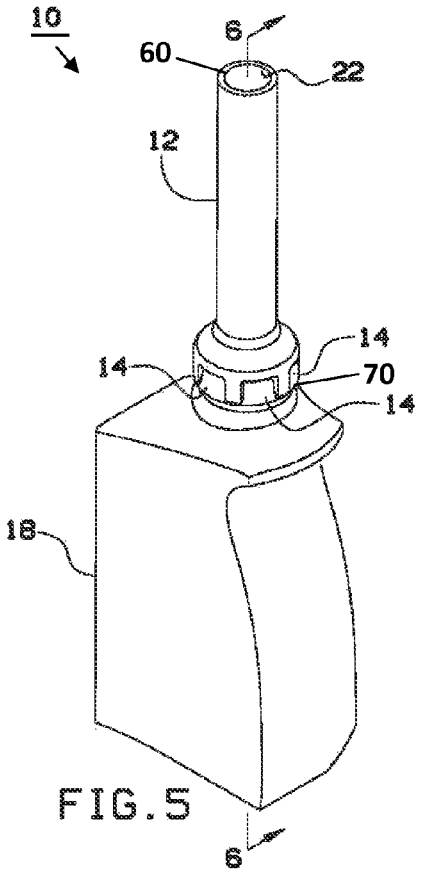
FIG. 5 is a perspective view of the invention shown installed on a one quart oil container 18.
Figure 6:
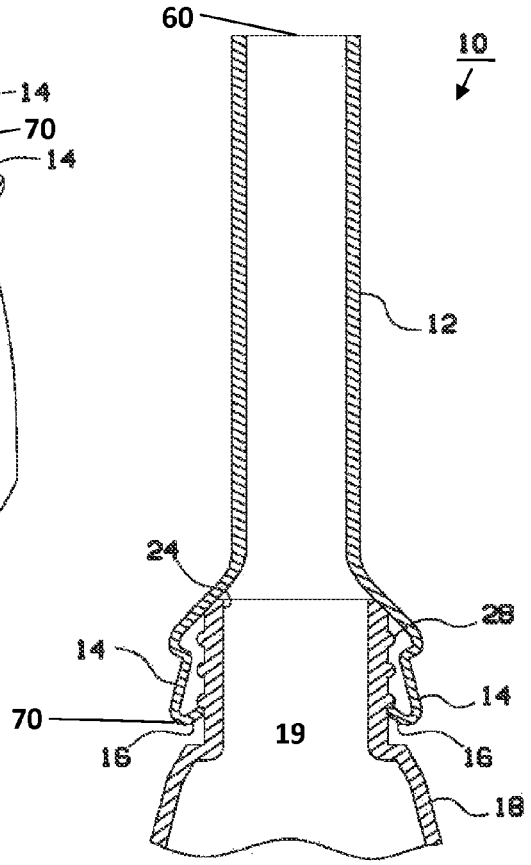
FIG. 6 is a detailed section view of the invention taken along line 6-6 in FIG. 5.
Figure 7:
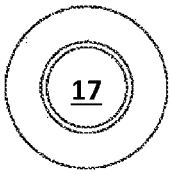
FIG. 7 is a top view of the invention.

As shown in FIG. 4, proximal portion of pouring device 10 forms a mouth 13 into which container 26 is inserted. Flange 16 may engage with neck 19 of container 26. Alternatively, and depending on the configuration of container 26, flange may engage with container threads 28, as shown in FIG. 6.

Upon successful engagement of pouring device 10 with container 18, 26, the system is inverted, inserted into capless fuel system inlet 34, and pushed downward so opening flap 36 is maintained in opened position. Flowing fuel additive 20 is then transferred from container 18, 26 into vehicle. This is shown in FIG. 4.

Flange 16 defines aperture 17 at proximal end 70 of pouring device 10. As shown in FIG. 3, distal end 60 is the pouring end of the device. Aperture desirably has a diameter of approximately 19 mm to 22 mm, with 20 mm to 21 mm being most desired. In use, however, this aperture can expand to have a diameter of approximately 25 mm. The limits of expansion do not permit damage to structural integrity pouring device 10, as such damage could permit leakage or lessen frictional hold with container. In other words, there can't be ripping, cracking and so forth to device.

Figure 8:
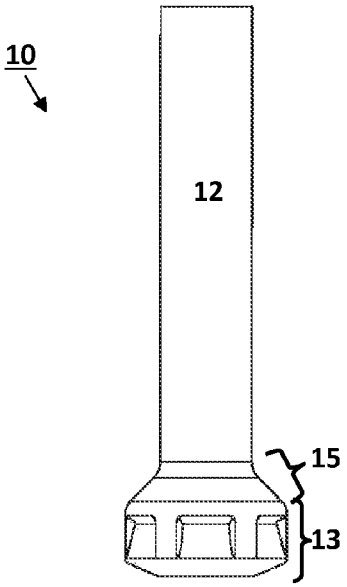
FIG. 8 is a front view of the invention.
Figure 9:
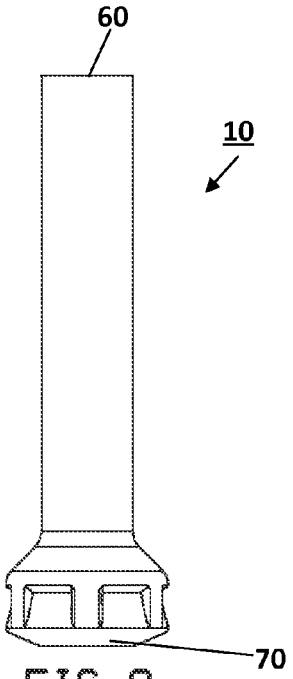
FIG. 9 is a side view of the invention.
Figure 10:
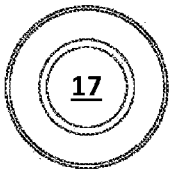
FIG. 10 is a bottom view of the invention.

This expansion is facilitated by hinge points 14 around perimeter of mouth. It is desirable that each pouring device 10 includes a plurality of recessed rectangular hinge points 14, with 6 hinge points used for the current pouring device 10 geometries. Other embodiments could use from 4 to 60 hinge points. It is desirable that each hinge point is angled inwardly towards nozzle 12 (best shown in FIGS. 8 and 9 to accommodate an appropriate balance between structural integrity and flexibility). While the circumference of the mouth is adjustable to accommodate various sized containers' necks, and therefore openings 24, 32, nozzle 12 has a fixed circumference.

As shown in FIG. 2, between cylindrical nozzle 12 and mouth 13 is angled transition 15, which extends inwardly going from mouth to nozzle. Nozzle 12 has a diameter of approximately 20.57 mm, and a length of approximately 100 mm, and is termed an elongated nozzle because the length of the hollow portion is greater than the diameter of the hollow portion. The mouth defines a shortened cylinder, so named because the longitudinal length of the hollow portion is less than the diameter of the hollow portion. Diameter of elongated hollow portion is less than diameter of shortened hollow portion. Mouth desirably has a diameter of approximately 21.7 mm, and a length of approximately 10 mm.

Pouring device 10 desirably has a unitary construction, such as that achieved by blow molding. Suitable materials include high density polyethylene and low density polyethylene, with a blend of seventy five percent (75%) high density polyethylene and twenty five percent (25%) low density polyethylene being most preferred. An example of an appropriate high density polyethylene is Paxon commercially available from Exxon Mobile Chemical of Lagrange, Ga. An example of an appropriate low density polyethylene is Paxothene, commercially available from Lyondellbasell Industries of (Cincinnati, Ohio). It is desirable that the blend and type of materials used constitute the appropriate thickness of the form so as to provide enough rigidity to perform as desired.

It should be understood, of course, that the foregoing relates to exemplary embodiments of the invention and that modifications may be made without departing from the spirit and scope of the invention as set forth in the following claims. Although the embodiments of the invention are described and illustrated as being used in connection with standard capless fuel systems, it should be understood that the present inventions could likewise be used on conventional capped fuel systems known in the art. The invention could also be used in connection with other industries, such as healthcare, food, beverage, household, chemicals and construction where rapid interchangeability of pourable matter delivery devices is desirable, especially to prevent cross-contamination. It should also be understood that ranges of values set forth inherently include those values, as well as all increments between. In addition, the dimensional ranges may vary based on the overall dimensional characteristics of the associated application of the device.

What is claimed is:

1. A pourable matter delivery system including:

A. A container having a neck defining an opening; and

B. A pouring device having a distal pouring end and a proximal attaching end detachably engaged with said neck, said pouring device including:

i. an elongated nozzle having a fixed circumference at said distal end, ii. an angled transition positioned contiguous to said elongated nozzle, iii. a plurality of inwardly angled hinge points positioned contiguous to said angled transition, and iv. a singular flange positioned contiguous to said plurality of inwardly angled hinge points and forming a terminus of said proximal attaching end, said singular flange deformable to create a frictional, non-leakage, releasable hold on said neck, wherein said flange is angled in a direction away from said nozzle when said pouring device is not attached to said container, and said flange is angled in a direction towards said nozzle upon complete insertion of said neck into said mouth.

2. The pourable matter delivery system of claim 1 wherein said neck includes outwardly directed threads.

3. The pourable matter delivery system of claim 2 wherein said flange is engaged with said threads.

4. The pourable matter delivery system of claim 1 wherein said plurality of inwardly angled hinge points are rectangular.

5. The pourable matter delivery system of claim 4 wherein said plurality of inwardly angled hinge points includes between 4 and 60 hinge points.

6. The pourable matter delivery system of claim 5 wherein said plurality of inwardly angled hinge points includes 6 hinge points.

* * * * *